United States Patent [19]

Webber

[11] 4,414,956

[45] Nov. 15, 1983

[54] HEATER CLOSURE ATTACHMENT FOR DRUMS

[76] Inventor: Furman L. Webber, 116 Delinger Rd., Shelby, N.C. 28150

[21] Appl. No.: 266,096

[22] Filed: May 21, 1981

[51] Int. Cl.[3] ..... F24C 1/16

[52] U.S. Cl. ..... 126/59; 126/77; 126/217; 126/225

[58] Field of Search ..... 126/225, 224, 24 B, 126/9 R, 59, 59.5, 77, 71, 70, 72, 217, 211; 110/241, 251, 254

[56] References Cited

U.S. PATENT DOCUMENTS

| | | | |
|---|---|---|---|
| 568,393 | 9/1896 | Wilson | 126/59 |
| 651,262 | 6/1900 | McNaughton | 126/217 X |
| 974,290 | 11/1910 | Merritt | 126/217 X |
| 2,103,100 | 12/1937 | Strano et al. | 126/217 |
| 3,292,609 | 12/1966 | Powell | 126/59 X |
| 4,051,831 | 10/1977 | Schellens | 126/77 |

*Primary Examiner*—James C. Young
*Assistant Examiner*—Randall L. Green
*Attorney, Agent, or Firm*—Laurence R. Brown

[57] ABSTRACT

A heater closure attachment for 30 and 55 gallon metal drums which includes a main closure section provided with an exhaust stack and two depending draft inlet pipes, and a hinged section through which solid fuel is inserted, the inlet draft pipes having damper lids to control combustion and the whole attachment being in knock-down, readily portable form for assembly on the job by unskilled labor.

5 Claims, 5 Drawing Figures

HEATER CLOSURE ATTACHMENT FOR DRUMS

This invention relates generally to drum heaters of the salamander type and more particularly to a detachable, knock-down closure attachment for empty 30 and 55 gallon steel drums often found on job sites which will convert them to highly efficient drum heaters.

Such drum heaters are primarily used on construction sites and in other outdoor activities but can be used in open warehouses, garages, workshops, etc. by simple ventilation procedures. The simple replacement of the drum constitutes a "new" heater as opposed to a self-contained unit that would no longer be serviceable after the fire box burned out.

Accordingly, the main object of the present invention is to provide a closure attachment for steel drums which will convert them to extremely efficient drum heaters.

An important object of the present invention is to provide a heater closure attachment for steel drums which has simple, practical means of assembly and disassembly for ready transportation from one job site to another.

Another important object of the present invention is to provide a novel heater closure attachment for steel drums which is so efficient in use as to practically eliminate the usual ash residue of solid fuels.

A further important object of the present invention is to provide a closure attachment for drums of the type described which is susceptible of ready and economical manufacture, and which is strong and of long life in use.

Other objects and advantages of the present invention will become apparent during the course of the following description.

In the drawings, I have shown one embodiment of the invention. In this showing:

Figure 1:
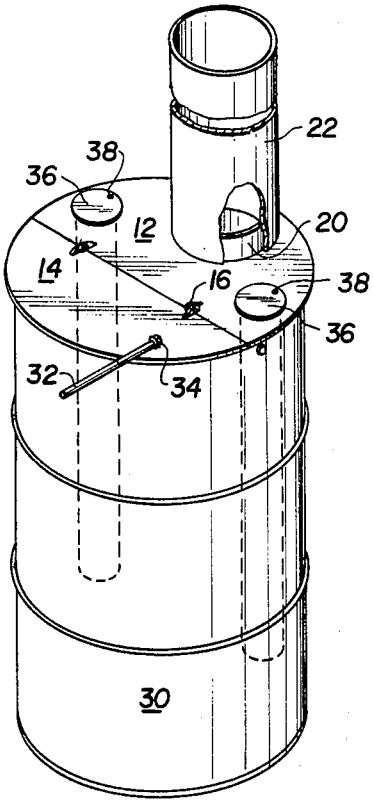
FIG. 1 is a perspective view of the closure attachment assembled and in opertive position on a steel drum to form a drum heater.
Figure 2:
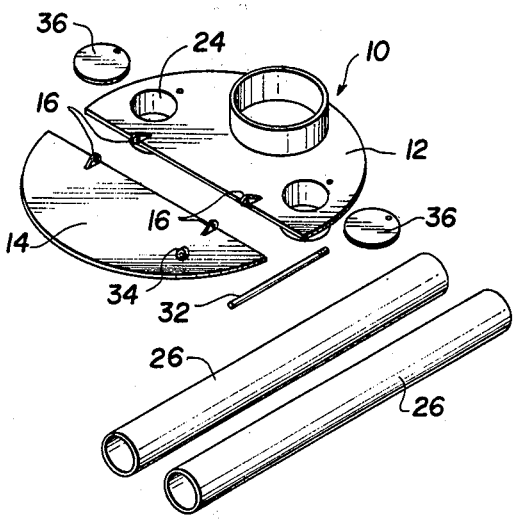
FIG. 2 is a perspective view of all of the closure attachment parts except the exhaust stack extension in disassembled condition.
Figure 3:
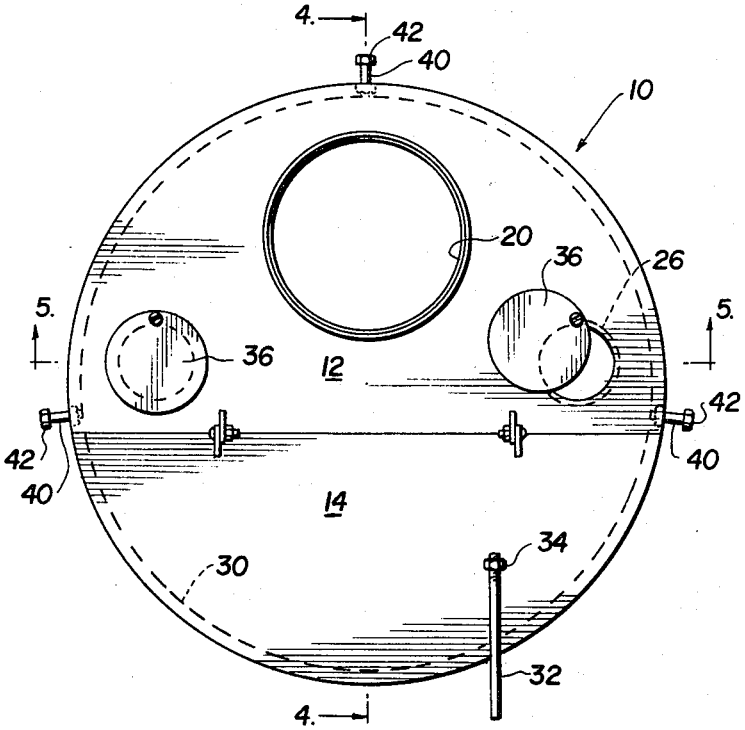
FIG. 3 is a top plan view of the closure attachment in assembled condition and mounted on a steel drum.
Figure 5:
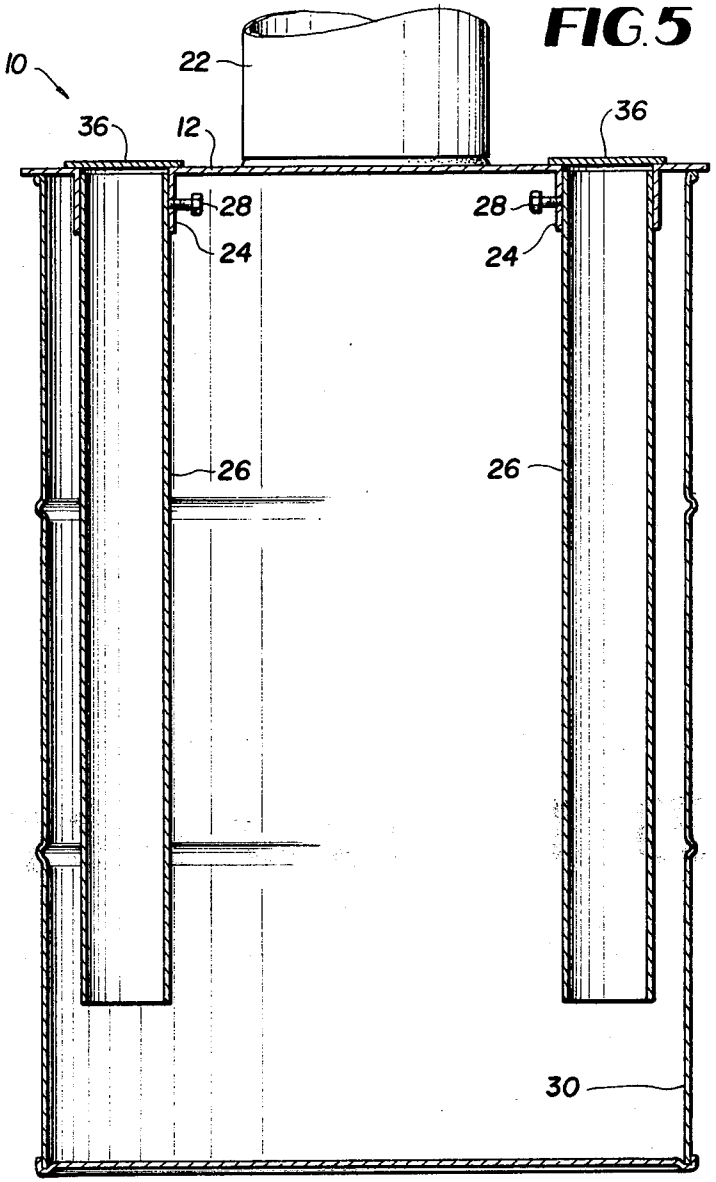
FIG. 5 is a similar view taken on the line 5—5 of FIG. 3.
Figure 4:
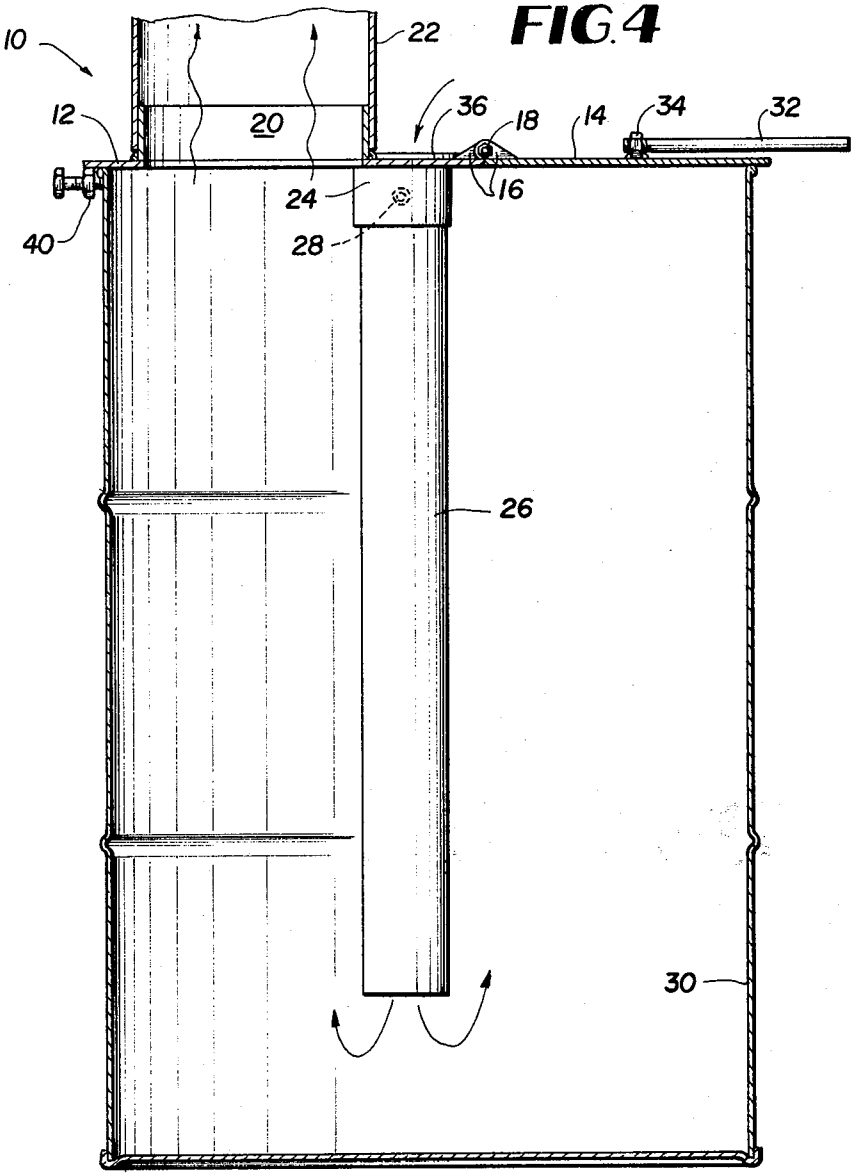
FIG. 4 is a vertical sectional view taken on the line 4—4 of FIG. 3.

Referring to the drawings, numeral 10 designates the closure attachment as a whole which comprises a two part circular metal top preferably of steel having a large section 12 and a smaller section 14. These are pivotedly connected by hinge members 16 welded to the top portions and connected by screws 18. The top section 14 constitutes the fuel loading door.

The larger top section 12 is provided with a large exhaust stack opening to the edges of which an upstanding exhaust sleeve 20 is welded. An exhaust stack extension 22 is placed over the sleeve 20.

The top 12 is also provided with two smaller air inlet openings to the edges of which depending sleeves 24 are welded. Each sleeve is provided with an air inlet flue 26 which is maintained in the sleeve by a jamb bolt 28.

It is to be noted that the air inlet flues 26 are designed and located to create a turbulent draft at the bottom of an oil drum 30. This results in a more efficient flame pattern which burns the solid fuel material completely. The use of costly fuel oil is eliminated as job site scraps are utilized and pieces of wood up to the length of the drum can be burnt with substantially no ash.

The flues 26 extend to within four inches of the bottom of the drum 30 which puts the flame under the fuel rather than at the top as in other heaters. Also, the relative size of the air inlet flues 26 with respect to the exhaust stack 22 has been found to be important. As shown, the flues are three inches in diameter and the stack is eight. If the stack size should be reduced to six inches, the turbulent effect under the fuel would be destroyed. Thus, the cross-sectional area of the air inlet flues must be less than one half of that of the exhaust flue.

The top section 14 is pivoted to open position to insert fuel by means of a rod 32 which is threaded at one end of reception in a nut 34 welded to the section 14. It is desirable to remove the rod 32 between fuel loadings to prevent its becoming excessively hot. The flow of air through the inlet flues 26 is controlled by damper lids 36 which are pivotally mounted on the top section 12 by round headed screws and nuts 38.

The top 10 is secured to the top of the drum 30 by means of three nuts 40 welded to the underside of the top 10 to receive three jamb bolts 42 which engage the drum. This decreases the danger of fire being spilled if the drum 30 is tipped over accidentally.

It will now be readily apparent that the novel attachment 10 comprising the present invention converts empty steel drums to highly efficient drum heaters in a very practical way at a minimal cost. This eliminates the need to transport cumbersome objects, can be done by one man, and provides a drum heater which is maintenance free with an unlimited life expectancy.

It is to be understood that the form of my invention herewith shown and described is to be taken as a preferred example of the same and that various changes in the shape, size and arrangement of parts my be resorted to without departure from the spirit of the invention or the scope of the subjoined claims.

What is claimed is:

1. A closure attachment for empty metallic cylindrical open top drums to form therewith a portable outdoor drum heater comprising, in combination, a metal top closure unit adapted to rest on the open top of the drum when in upright position; said top closure unit having a large exhaust opening and air inlet opening means; a manually openable fuel insertion door comprising a hinged portion of the top closure unit; and air inlet tubing comprising two tubes disposed on opposite sides of the drum depending from said air inlet opening means having a length extending to a position adjacent the bottom of said drum thereby to provide turbulent inlet air in a position under fuel placed in the drum for efficient and rapid burning of the fuel wherein the closure unit comprises a knock-down set of parts with two sleeves about two apertures in the closure unit constituting the air inlet opening means and means for removably securing to the sleeves the two air inlet tubes.

2. The combination recited in claim 1 wherein said air inlet opening means has a cross-sectional area less than one half that of said exhaust opening.

3. The combination recited in claim 1 wherein the cross-sectional area of said air inlet tubing is less than $\frac{1}{2}$ that of the exhaust opening.

4. The combination recited in claim 2 wherein damper lids control the flow of air through said inlet tubes.

5. The combination recited in claim 1 including fastener means retained in said closure unit for removably securing the closure unit in place on top of a drum.

* * * * *